US009445700B2

(12) United States Patent
Lv

(10) Patent No.: US 9,445,700 B2
(45) Date of Patent: Sep. 20, 2016

(54) GLASS-WIPING ROBOT

(71) Applicant: Ecovacs Robotics Co., Ltd., Suzhou (CN)

(72) Inventor: Xiaoming Lv, Suzhou (CN)

(73) Assignee: Ecovacs Robotics Co., Ltd., Suzhou (CN)

( * ) Notice: Subject to any disclaimer, the term of this patent is extended or adjusted under 35 U.S.C. 154(b) by 0 days.

(21) Appl. No.: 14/431,252

(22) PCT Filed: Sep. 26, 2013

(86) PCT No.: PCT/CN2013/084326
§ 371 (c)(1),
(2) Date: Jun. 6, 2015

(87) PCT Pub. No.: WO2014/048346
PCT Pub. Date: Apr. 3, 2014

(65) Prior Publication Data

US 2015/0272411 A1 Oct. 1, 2015

(30) Foreign Application Priority Data

Sep. 26, 2012 (CN) ..... 2012 1 0363597

(51) Int. Cl.
*A47L 1/02* (2006.01)

(52) U.S. Cl.
CPC ..... *A47L 1/02* (2013.01); *A47L 2201/00* (2013.01)

(58) Field of Classification Search
CPC ..... A47L 1/02
See application file for complete search history.

(56) References Cited

U.S. PATENT DOCUMENTS

| | | | | |
|---|---|---|---|---|
| 6,347,428 | B1 * | 2/2002 | Shimko et al. | 15/320 |
| 7,115,018 | B1 * | 10/2006 | Syverson | 451/6 |
| 8,024,995 | B2 * | 9/2011 | Dayton et al. | 81/52 |
| 2003/0070822 | A1 * | 4/2003 | Kanzaki et al. | 173/217 |
| 2012/0099256 | A1 * | 4/2012 | Fawcett et al. | 361/679.01 |

FOREIGN PATENT DOCUMENTS

| | | |
|---|---|---|
| CN | 1197626 | 11/1998 |
| CN | 1767292 | 5/2006 |
| CN | 201098079 | 8/2008 |
| CN | 201234951 | 8/2008 |

(Continued)

OTHER PUBLICATIONS

International Search Report and Written Opinion mailed Jan. 2, 2014 which issued in corresponding International Patent Application No. PCT/CN2013/084326 (16 pages).

*Primary Examiner* — Shay Karls
(74) *Attorney, Agent, or Firm* — Nixon Peabody LLP

(57) ABSTRACT

A glass-wiping robot comprising a glass-wiping robot housing (1), a power cord (2) extending outward through the housing (1), a protruding mechanism (3) provided on the housing (1) and protruding from the surface thereof, and a power cord positioning sheath (4) provided on the housing (1), where the power cord (2) passes through a central through-hole of the power cord positioning sheath (4) and is fixed. By providing the power cord positioning sheath (4), the glass-wiping robot ensures that the power cord (2) does not interfere with other parts on the surface of the machine body of the glass-wiping robot, prevents the power cord (2) from hanging downward and winding when the glass-wiping robot is working, provides a simplified structure, and greatly improves the operational safety of the glass-wiping robot.

20 Claims, 2 Drawing Sheets

(56) References Cited

FOREIGN PATENT DOCUMENTS

| | | | |
|---|---|---|---|
| CN | 202843502 | | 4/2013 |
| FR | 2 230 322 | A1 | 12/1974 |
| FR | 2 315 895 | A1 | 1/1977 |
| GB | 2324713 | | 11/1998 |
| JP | 2000-254056 | | 9/2000 |
| KR | 100 780 647 | B1 | 11/2007 |
| KR | 100 881 926 | B1 | 2/2009 |

* cited by examiner

GLASS-WIPING ROBOT

CROSS-REFERENCE TO RELATED APPLICATIONS

This application is an U.S. national stage of PCT/CN2013/084326, filed on Sep. 26, 2013, which claims priority to Chinese Patent Application No. 201210363597.7, filed on Sep. 26, 2012, the contents of which are each incorporated herein by reference in its entirety.

FIELD OF THE INVENTION

The present invention relates to a glass-wiping robot, belonging to the technical field of small household appliances.

BACK GROUND OF THE PRIOR ART

The glass-wiping robot, also called Winbot, is a new type of small household appliance, and is being highly praised by consumers because of its small size, light weight and high flexibility of movement. Nowadays, a commercially available Winbot has a handle arranged on the machine body and protruding from the external surface of the housing. The handle facilitates handling and is used to put the Winbot on the glass surface to be cleaned before starting operating. However, in the process of operating, in particular, in the process of turning around, the power cord is very likely to wind around the handle due to Winbot's flexible mobile operating mode. Such winding will not only influence the movement track during operating but also make the power cord to be pulled, and thus even results in potential risks such as power outage and power leakage.

SUMMARY OF THE INVENTION

With view of the deficiency of the prior art, the present invention intends to provide a glass-wiping robot in which a power cord positioning sheath with a simple structure is provided on the machine body so as to ensure that the power cord does not interfere with other parts on the surface of the machine body, prevent the power cord from hanging down and winding around the handle when the glass-wiping robot is working, and significantly improve the operational safety of the glass-wiping robot.

The present invention is achieved through the technical solutions as follows.

A glass-wiping robot comprising a glass-wiping robot housing, a power cord extending outward through the housing, a protruding mechanism provided on the housing and protruding from the external surface thereof, and a power cord positioning sheath arranged on the housing, wherein the power cord passes through a central through-hole of the power cord positioning sheath and is fixed.

In order to prevent the power cord from winding around the protruding mechanism in the operating state of the glass-wiping robot, the height of the power cord positioning sheath is greater than that of the protruding mechanism.

Furthermore, in the case where the height of the power cord positioning sheath is 0 to 5 mm smaller than that of the protruding mechanism, the power cord would also not wind around the protruding mechanism.

The positioning sheath is formed into a cylinder shape and penetrated through integrally together with the upper surface of the housing, and the power cord passes through the cylindrical through-hole and is fixed. The protruding mechanism may be a handle, and the power cord positioning sheath is arranged on the handle on the housing.

In order to facilitate the spatial layout and effectively prevent the power cord from winding, the power cord positioning sheath is arranged at the edge of the handle, and the part of the power cord extending outward from the housing and passing through the power cord positioning sheath is perpendicular to the plane where the handle is.

In order to save materials, the power cord positioning sheath is of a ring shape, and the power cord is partly wrapped in the positioning sheath.

From the above, the present invention provides a glass-wiping robot which ensures that the power cord does not interfere with other parts on the surface of the machine body, prevents the power cord from hanging downward and winding when the glass-wiping robot is working, and in particular, effectively prevents the power cord from winding around the protruding part or the protruding mechanism on the surface of the machine body by providing a power cord positioning sheath on the machine body. The present invention greatly improves the operational safety of the glass-wiping robot with a simplified structure.

Hereinafter, the technical solutions of the invention will be described in detail in conjunction with the attached drawings and specific embodiments.

DESCRIPTION OF ATTACHED DRAWINGS

DETAILED DESCRIPTION OF PREFERRED EMBODIMENTS

The First Embodiment

Figure 1:
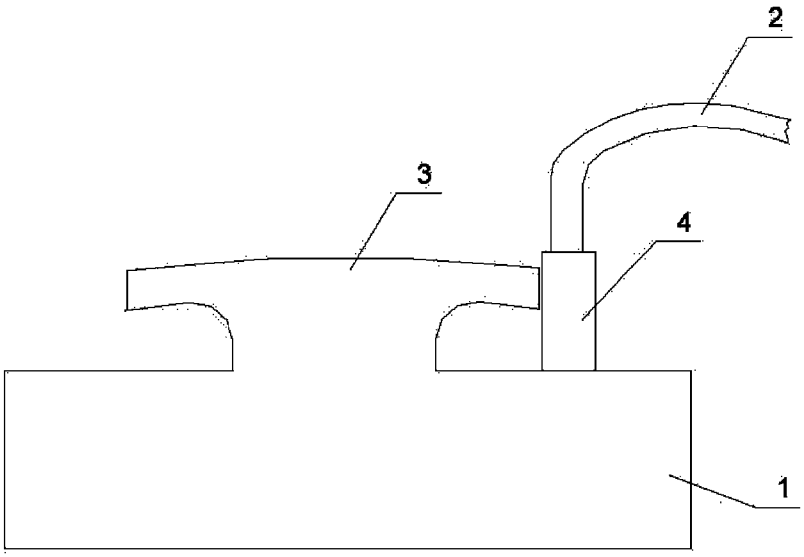
FIG. 1 is a schematic diagram of the structure of the first embodiment according to the present invention.

FIG. 1 is a schematic diagram of the structure of the first embodiment according to the present invention. As illustrated in FIG. 1, the invention provides a glass-wiping robot comprising a glass-wiping robot housing 1, a power cord 2 extending outward through the housing 1, a protruding mechanism 3 provided on the housing 1 and protruding from the external surface thereof, and a power cord positioning sheath 4 provided on the housing 1, wherein The positioning sheath 4 is formed into a cylinder shape and penetrated through integrally together with the upper surface of the housing 1, and the power cord 2 passes through a central through-hole in the power cord positioning sheath 4 and is fixed. In order to prevent the power cord 2 from winding around the protruding mechanism 3 in the operating state of the glass-wiping robot, the height of the power cord positioning sheath 4 is greater than that of the protruding mechanism 3.

As illustrated in FIG. 1, in the process of operating, since the power cord positioning sheath 4 is provided on the housing 1, the part of the power cord 2 extending outward from the housing 1 and passing through the positioning sheath 4 keeps perpendicular to the plane where the protruding mechanism 3 is regardless of the movements of the glass-wiping robot. In this way, whether straight-line movement or turning movement the glass-wiping robot are performing, the power cord 2 would not wind around the machine body or the protruding mechanism 3 of the glass-wiping robot, greatly improving the operational safety of the glass-wiping robot.

The Second Embodiment

Figure 2:
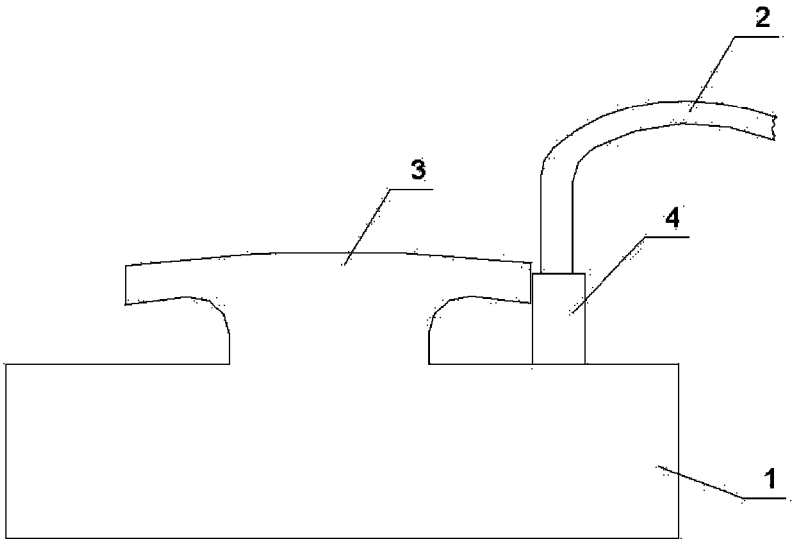
FIG. 2 is a schematic diagram of the structure of the second embodiment according to the present invention.

FIG. 2 is a schematic diagram of the structure of the second embodiment according to the present invention. The distinction of the embodiment illustrated in FIG. 2 from the first embodiment is that the height difference between the power cord positioning sheath 4 and the protruding mechanism 3 is different. In the first embodiment, the power cord positioning sheath 4 is higher than the protruding mechanism 3, whereas in the present embodiment, the height of the power cord positioning sheath 4 is smaller than or equal to that of the protruding mechanism 3, and preferably, the height difference between the power cord positioning sheath 4 and the protruding mechanism 3 is controlled to be 0 to 5 mm. That is to say, when the height of the power cord positioning sheath 4 is smaller than or equal to that of the protruding mechanism 3, the power cord 2 would also not wind around the machine body or the protruding mechanism 3 due to a small height difference between the power cord positioning sheath 4 and the protruding mechanism 3. In particular, as illustrated in FIG. 2, even if the height of the power cord positioning sheath 4 is smaller than or equal to that of the protruding mechanism 3, the height of the part of the power cord 2 protruding from the power cord positioning sheath 4 would still be greater than or equal to that of the protruding mechanism 3 as long as the power cord 2 itself has a certain hardness. Accordingly, the power cord 2 would also not wind around the protruding mechanism 3.

Apart from the height difference between the power cord positioning sheath 4 and the protruding mechanism 3, other technical features of the present embodiment are same as that of the first embodiment and thus are omitted herein.

The Third Embodiment

Figure 3:
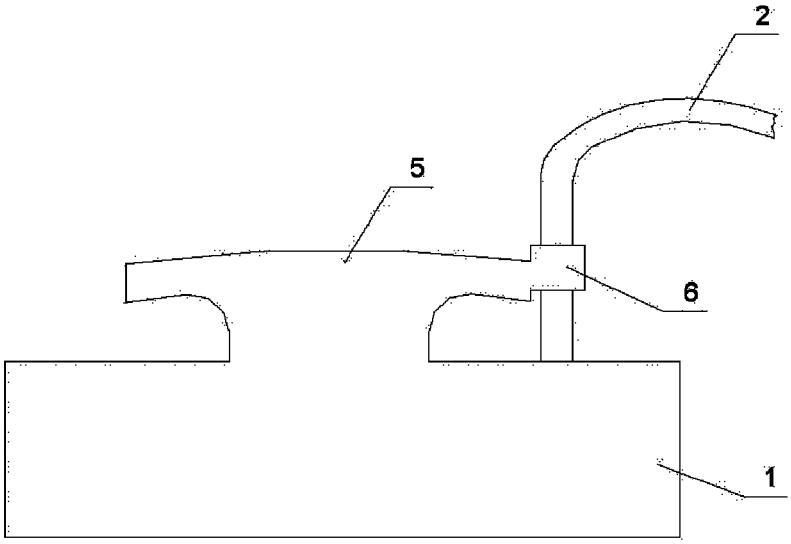
FIG. 3 is a schematic diagram of the structure of the third embodiment according to the present invention.
Figure 4:
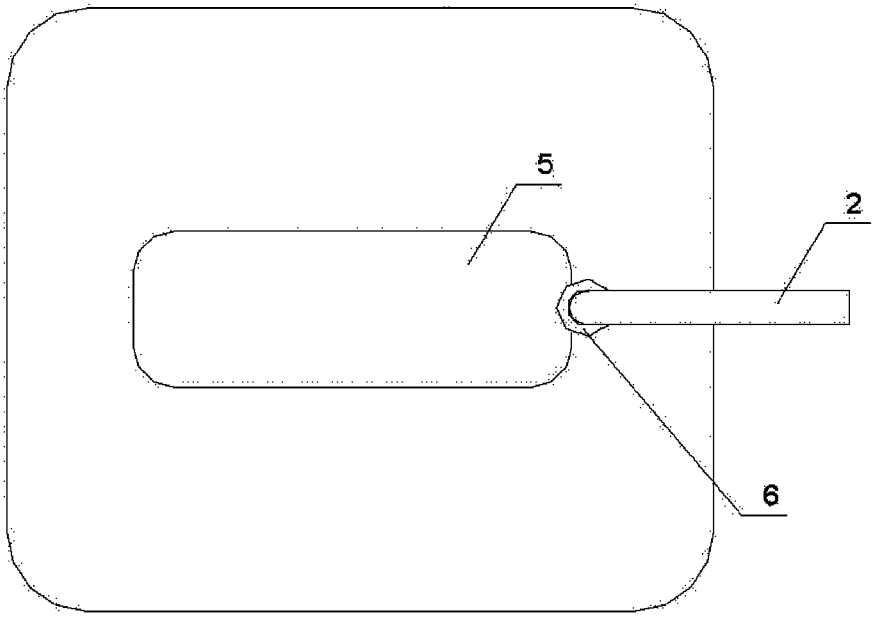
FIG. 4 is a top view of FIG. 3.

FIG. 3 is a schematic diagram of the structure of the third embodiment according to the present invention, and FIG. 4 is a top view of FIG. 3. As illustrated in FIG. 3 in conjunction with FIG. 4, in the present embodiment, the protruding mechanism 3 may be a handle 5, and a power cord positioning sheath 6 is arranged on the handle 5 on the housing 1. In order to facilitate the spatial layout and effectively prevent the power cord from winding, the power cord positioning sheath 6 is arranged at the edge of the handle 5, and the part of the power cord 2 extending outward from the housing 1 and passing through the power cord positioning sheath 6 is perpendicular to the plane where the handle 5 is. For saving materials, in the present embodiment, the power cord positioning sheath 6 is designed to be of a ring shape, and the power cord 2 is partly wrapped in the power cord positioning sheath 6. In this way, it is ensured that the power cord 2 would not wind around the machine body or the handle 5 during the moving of the glass-wiping robot.

Of course, the handle in the present embodiment is just one example. It is appreciated that the protruding mechanism is not limited to the handle and different kinds of protruding mechanisms may be provided on different types of glass-wiping robots. Anyway, no matter what kind of protruding mechanism is provided, it is able to prevent the power cord from winding around the machine body or the protruding mechanism in the moving process of the glass-wiping robot by providing the power cord positioning sheath on the surface of the housing.

In conclusion, the invention provides a glass-wiping robot in which a power cord positioning sheath is provided, on a protruding mechanism (for example, a handle) of the glass-wiping robot or directly on the glass-wiping robot, to fix the power cord so that the part of power cord extending outward from the housing of the glass-wiping robot is perpendicular to the surface of machine body or the surface where the protruding mechanism is, thereby effectively preventing the power cord from winding. The height of the power cord positioning sheath is greater than that of the protruding mechanism or the height of the power cord positioning sheath is 0 to 5 mm smaller than that of the protruding mechanism, both of which can achieve the goal that the power cord is not wound. The arrangement and location of the power cord positioning sheath with a simple structure keeps the power cord perpendicular to the plane where the protruding mechanism is or the operating surface of the glass-wiping robot, ensures that the power cord does not interfere with other parts on the surface of the machine body, prevents the power cord from hanging downward and winding when the glass-wiping robot is working, and greatly improves the operational safety of the glass-wiping robot.

Note that, it shall be understood that the power cord herein also include cords playing the role of power connection or protection, such as safety cords or safety power cables. Furthermore, the primary function of the positioning sheath in this invention is to prevent the power cord from winding around the machine body or the protruding mechanism, and the specific shapes of the central through-hole gripping the power cord may be varied according to users' needs, such as a C-shaped gripping portion, a pincer-shaped gripping portion, an engaging portion or the like.

The invention claimed is:

1. An autonomous glass-wiping robot comprising: a glass-wiping robot housing (1), a power cord (2) extending outward through the housing (1), a protruding mechanism (3) provided on the housing (1) and protruding from the external surface of the housing (1), characterized in that, a power cord positioning sheath (4) is provided on the housing (1), the power cord (2) passes through a central through-hole of the power cord positioning sheath (4) and is fixed, and wherein the power cord positioning sheath protrudes from the external surface of the housing in substantially a same direction as the protruding mechanism and away from a surface upon which the glass-wiping robot is configured to move.

2. The glass-wiping robot of claim 1, characterized in that, the height of the power cord positioning sheath (4) is greater than that of the protruding mechanism (3).

3. The glass-wiping robot of claim 2, characterized in that, the power cord positioning sheath (4) is formed into a cylinder shape and penetrated through integrally together with the upper surface of the housing (1), and the power cord (2) passes through the central through-hole in the cylinder and is fixed.

4. The glass-wiping robot of claim 2, characterized in that, the protruding mechanism is a handle (5), and the power cord positioning sheath (6) is arranged on the handle (5) on the housing.

5. The glass-wiping robot of claim 4, characterized in that, the power cord positioning sheath (6) is arranged at the edge of the handle (5), and the part of the power cord (2) extending outward from the housing (1) and passing through the power cord positioning sheath (6) is perpendicular to the plane where the handle (5) is.

6. The glass-wiping robot of claim 5, characterized in that, the power cord positioning sheath (6) is of a ring shape, and the power cord (2) is partly wrapped in the power cord positioning sheath (6).

7. The glass-wiping robot of claim 1, characterized in that, the height of the power cord positioning sheath (4) is 0 to 5 mm smaller than that of the protruding mechanism (3).

8. The glass-wiping robot of claim 7, characterized in that, the power cord positioning sheath (4) is formed into a cylinder shape and penetrated through integrally together with the upper surface of the housing (1), and the power cord (2) passes through the central through-hole in the cylinder and is fixed.

9. The glass-wiping robot of claim 7, characterized in that, the protruding mechanism is a handle (5), and the power cord positioning sheath (6) is arranged on the handle (5) on the housing.

10. The glass-wiping robot of claim 9, characterized in that, the power cord positioning sheath (6) is arranged at the edge of the handle (5), and the part of the power cord (2) extending outward from the housing (1) and passing through the power cord positioning sheath (6) is perpendicular to the plane where the handle (5) is.

11. The glass-wiping robot of claim 10, characterized in that, the power cord positioning sheath (6) is of a ring shape, and the power cord (2) is partly wrapped in the power cord positioning sheath (6).

12. The glass-wiping robot of claim 1, characterized in that, the protruding mechanism is a handle (5), and the power cord positioning sheath (6) is arranged on the handle (5).

13. The glass-wiping robot of claim 12, characterized in that, the power cord positioning sheath (6) is arranged at the edge of the handle (5), and the part of the power cord (2) extending outward from the housing (1) and passing through the power cord positioning sheath (6) is perpendicular to the plane where the handle (5) is.

14. The glass-wiping robot of claim 13, characterized in that, the power cord positioning sheath (6) is of a ring shape, and the power cord (2) is partly wrapped in the power cord positioning sheath (6).

15. A glass-wiping robot comprising:

a glass-wiping robot housing, a power cord positioning sheath having a proximal end attached to a first portion of an upper surface of the glass-wiping robot housing and a distal end disposed at a height above the upper surface of the glass-wiping robot housing that is substantially equal to or greater than a height of a protruding member protruding from an uppermost surface of the glass-wiping robot housing, the power cord positioning sheath defining a central through-hole dimensioned to receive a power cord; and a power cord extending outwardly from an upper surface of the glass-wiping robot housing, through the central through-hole of the power cord positioning sheath, and outwardly from the distal end of the power cord positioning sheath, wherein, during translational or rotational movement of the glass-wiping robot, the power cord does not entangle with the protruding member due to the relative positioning of the distal end of the power cord positioning sheath relative to the height of the uppermost surface of the glass-wiping robot housing.

16. The glass-wiping robot of claim 15, wherein the height of the distal end of the power cord positioning sheath is above the height of the uppermost surface of the glass-wiping robot housing or protrusions therefrom.

17. The glass-wiping robot of claim 15, wherein the height of the distal end of the power cord positioning sheath is equal to the height of the uppermost surface of the glass-wiping robot housing or protrusions therefrom, or is up to about 5 mm below the height of the uppermost surface of the glass-wiping robot housing or protrusions therefrom.

18. The glass-wiping robot of claim 15, wherein the uppermost surface of the glass-wiping robot housing or protrusions therefrom comprises a portion of a handle defined by the glass-wiping robot housing or protrusions therefrom.

19. The glass-wiping robot of claim 15, wherein the power cord positioning sheath is integrated with a handle defined by the glass-wiping robot housing or protrusions therefrom.

20. The glass-wiping robot of claim 15, wherein the power cord positioning sheath extends in a direction substantially perpendicular to a plane along which the glass-wiping robot operates.

* * * * *